US007413372B2

(12) United States Patent
Meyers

(10) Patent No.: US 7,413,372 B2
(45) Date of Patent: Aug. 19, 2008

(54) TRENCH DRAIN FRAME AND GRATE ASSEMBLY

(75) Inventor: Theodore W. Meyers, Barrington, IL (US)

(73) Assignee: Tuf-Tite, Inc., Lake Zurich, IL (US)

( * ) Notice: Subject to any disclaimer, the term of this patent is extended or adjusted under 35 U.S.C. 154(b) by 85 days.

(21) Appl. No.: 11/110,588

(22) Filed: Apr. 20, 2005

(65) Prior Publication Data

US 2006/0239773 A1 Oct. 26, 2006

(51) Int. Cl.
*E01C 11/22* (2006.01)

(52) U.S. Cl. ..... 404/2; 404/3

(58) Field of Classification Search ..... 404/2–3
See application file for complete search history.

(56) References Cited

U.S. PATENT DOCUMENTS

| | | | | |
|---|---|---|---|---|
| 59,802 | A | | 11/1866 | Whitehead |
| 319,112 | A | * | 6/1885 | Nevius ..... 404/3 |
| 643,677 | A | | 2/1900 | Payne |
| 1,406,068 | A | | 2/1922 | Padgett |
| 1,444,198 | A | | 2/1923 | McQueary |
| 1,457,637 | A | | 6/1923 | Sievers |
| 1,998,514 | A | | 4/1935 | Miller |
| 2,386,020 | A | | 10/1945 | Wendelken |
| 2,419,996 | A | | 5/1947 | Honikman |
| 2,436,593 | A | | 2/1948 | Moselowitz |
| 2,701,027 | A | | 2/1955 | Scoville |
| 2,938,437 | A | | 5/1960 | Daley |
| 3,225,545 | A | | 12/1965 | Flegel |
| RE26,366 | E | | 4/1968 | Flegel |
| 3,465,654 | A | | 9/1969 | Fox |
| 3,714,786 | A | | 2/1973 | Evans et al. |

(Continued)

FOREIGN PATENT DOCUMENTS

DE 3634289 A1 4/1988

(Continued)

OTHER PUBLICATIONS

NDS' catalog entitled "How to Install Exterior Surface Drainage", Camarillo, CA, May 1990.

(Continued)

*Primary Examiner*—Raymond W Addie
(74) *Attorney, Agent, or Firm*—Marshall, Gerstein & Borun LLP

(57) ABSTRACT

A trench drain frame, and associated grate, adapted to be mounted atop a commonly available drain pipe, for casting-in-concrete in poured concrete or packed asphalt, or otherwise embedding in a suitably tightly packed supporting material, the frame having a pair of connected side walls, each side wall having a lower base portion with downwardly extending support wall to position and support the trench drain frame over the associated underlying pipe. Once the assembled frame, grate and pipe are cast in concrete, or otherwise supported, the grate is removed, and at least portions of the top of the pipe are removed to expose the interior of the pipe for drainage purposes, and the grate is secured to the trench drain frame. A separable end plate can be used to close off a cut-open end of the trench drain frame, when the later is cut short for a given application.

33 Claims, 9 Drawing Sheets

U.S. PATENT DOCUMENTS 3,788,756 A 1/1974 Ito
3,815,213 A 6/1974 Evans et al.
3,876,322 A 4/1975 Deason
3,882,743 A 5/1975 Evans et al.
3,898,778 A 8/1975 Erickson et al.
3,974,599 A * 8/1976 Grosh ..... 52/20
D242,622 S 12/1976 Ito
D242,623 S 12/1976 Ito
D243,094 S 1/1977 Ito
4,190,988 A 3/1980 Carreiro
4,273,466 A 6/1981 Trahan, Sr. et al.
4,365,911 A 12/1982 Rossberg
4,407,055 A 10/1983 Rossberg
4,451,172 A 5/1984 Lamphier et al.
4,490,067 A 12/1984 Dahowski
4,498,807 A 2/1985 Kirkpatrick et al.
4,498,907 A * 2/1985 Juguin et al. ..... 208/89
4,515,498 A 5/1985 Thomann et al.
4,553,874 A 11/1985 Thomann et al.
RE32,248 E 9/1986 Blecher
4,621,939 A 11/1986 Thomann et al.
4,630,962 A 12/1986 Thomann et al.
4,630,966 A 12/1986 Karbstein
4,640,643 A 2/1987 Williams
4,699,544 A 10/1987 Karbstein
4,751,945 A 6/1988 Williams
4,787,773 A 11/1988 Kehler
D299,543 S 1/1989 Phillips
4,815,888 A 3/1989 Stegmeier
4,838,727 A 6/1989 Capuano
4,844,655 A 7/1989 Aleshire
4,904,113 A 2/1990 Goddard et al.
4,940,359 A 7/1990 Van Duyn et al.
RE33,439 E 11/1990 Thomann et al.
4,968,170 A 11/1990 Wilson et al.
D312,696 S 12/1990 Phillips
4,993,877 A 2/1991 Beamer
4,993,878 A 2/1991 Beamer
5,000,621 A 3/1991 Beamer
5,001,621 A 3/1991 Egawa
5,024,550 A 6/1991 Mainville
5,026,202 A 6/1991 Thomann
5,061,116 A 10/1991 Monks
5,066,165 A 11/1991 Wofford et al.
5,130,016 A 7/1992 Gavin
5,181,793 A 1/1993 Dekel
5,213,438 A 5/1993 Barenwald
5,226,748 A 7/1993 Barenwald et al.
5,256,000 A 10/1993 Beamer
5,281,051 A 1/1994 Stegall
5,281,052 A 1/1994 Beamer
5,340,234 A 8/1994 Rossi et al.
5,348,421 A 9/1994 Stegall
5,372,457 A * 12/1994 Rante ..... 405/119
5,380,121 A 1/1995 Schluter
5,393,171 A 2/1995 Stegall
5,399,047 A 3/1995 Stegall
5,443,327 A 8/1995 Akkala et al.
5,462,383 A 10/1995 Van 'T Veer
5,478,169 A 12/1995 Stegall
5,522,675 A 6/1996 Gunter
5,529,436 A * 6/1996 Meyers ..... 405/119
5,538,361 A 7/1996 Beamer
5,564,857 A 10/1996 Schluter
5,568,995 A 10/1996 Beamer
5,573,350 A 11/1996 Stegall
5,573,351 A 11/1996 Beamer
5,613,804 A 3/1997 Beamer
5,647,689 A 7/1997 Gunter
5,647,692 A 7/1997 Gunter
5,653,553 A 8/1997 Gunter
5,702,204 A 12/1997 Gunter
5,718,537 A 2/1998 Becker et al.
5,729,937 A 3/1998 Mantelli
5,735,637 A 4/1998 Gunter
5,735,638 A 4/1998 Beamer
5,779,393 A 7/1998 Gunter
5,803,662 A 9/1998 Gunter
5,853,265 A 12/1998 Gunter
5,890,839 A 4/1999 Gunter
5,908,266 A 6/1999 Miller
5,971,662 A * 10/1999 Becker et al. ..... 405/119
6,000,881 A 12/1999 Becker et al.
6,004,068 A * 12/1999 Hosley ..... 405/118
6,027,283 A * 2/2000 Schweinberg et al. ..... 405/42
6,113,311 A 9/2000 Becker et al.
6,141,916 A 11/2000 Shackelford
6,220,784 B1 4/2001 Bricker
6,234,711 B1 5/2001 Beaman
6,254,307 B1 7/2001 Ragold
6,280,117 B1 8/2001 Obermeyer et al.
6,340,234 B1 * 1/2002 Brown, Jr. ..... 362/105
6,385,913 B1 5/2002 Ahn
6,443,656 B1 9/2002 Gunter
6,533,497 B2 3/2003 Gunter
6,540,437 B1 4/2003 Larson
6,595,720 B2 7/2003 Humphries et al.
6,612,780 B2 9/2003 Dahowski et al.
6,663,317 B1 12/2003 Williams et al.
6,688,806 B2 * 2/2004 Kuan ..... 404/25
6,729,795 B2 5/2004 Dahowski et al.
6,746,179 B1 6/2004 Kerkhoff
6,908,256 B1 6/2005 Humphries et al. ..... 404/2
6,926,245 B2 8/2005 Wallace et al.
7,108,783 B2 9/2006 Glazik
7,125,506 B2 10/2006 Humphries et al.
7,172,368 B2 2/2007 Wallace et al.
2004/0005192 A1 * 1/2004 Chapek ..... 405/39
2005/0238435 A1 10/2005 Wallace et al.
2005/0238436 A1 10/2005 Wallace et al.
2007/0144954 A1 6/2007 Neuber
2008/0025797 A1 1/2008 Brafford, Jr. et al.
2008/0025798 A1 * 1/2008 Humphries et al. ..... 405/121

FOREIGN PATENT DOCUMENTS

GB 1071497 6/1967
GB 2222624 3/1990

OTHER PUBLICATIONS

Pages from Wilkins' catalog entitled "Drainage, Regulators, Fittings For The 'Do It Yourselfer'", Valencia, CA, Understood to be publicly available at least as earlyas Mar. 2004.

Pages from Wilkins' Drainage Specifications Guide and Parts catalog, Saugus, CA, understood to be publicly available at least as early as Mar. 2004.

ABT, Inc.'s catalog entitled "Poly-Drain®—The Simple Solution To Surface Drainage", Troutman, NC, 1989.

Quazite Polycast's catalog entitled "Polycast®—Presloped Surface Drain System", Lenior City, TN, understood to be publicly available at least as early as Mar. 2004.

ACO Polymer Products, Inc.'s Catalog for Enviro-Flo® product, entitled "Durable Recycled Plastic Trench Drainage System", Chardon, OH, 1994.

Pages from ABT, Inc.'s Design Professionals Manual entiled "PolyDrain®—The Simple Solution to Surface Drainage", Troutman, NC, 1991.

Pages from Wilkins' Drainage catalog entitled "Catch Basin System and Specialty Item List Prices", Valencia, CA, understood to be publicly available at least as early as Mar. 2004.

Tuf-Tite's product information sheets for "Trench Drain TR1", Lake Zurich, IL, 2001.

L.M. Scofield Company's Tech-Data-Bulletin D-624.01 for Lithoscape™ product for "Lockdown™ Grates", Los Angeles, CA, 1986.

Front and Back covers from Nichols Co.'s catalog entitled "Gratings & Floorings", Tampa, FL, 1991.

Pages from American Drainage Products, Inc.'s catalog showing "7000/8000 Series 2" and 4" Channel Drain & Grates", Burbank, CA, 1991.

R&G Sloan Manufacturing Company's brochure entitled "Channel Drainage", Little Rock, AR, understood to be publicly available at least as early as Mar. 2004.

Pages from Wilkins Drainage Regulator Division's price list entitled "Performance Under Pressure List Prices", Saugus, CA, Dec. 1, 1989.

Pages from Wilkins Drainage's product information sheet entitled "Catch Basins Grates & Specialty Items—List Prices", Saugus, CA, Mar. 15, 1991.

MultiDrain Corporation's catalog for EconoDrain™ and MultiDrain™ products entitled "Our patented heavy-duty systems drain your sites. Without draining your budget", Atlanta, GA, 1995.

Pages from NDS' "Drainage Products" catalog, Apr. 2002.

Tuf-Tite's "Trench Drain Installation Guide (In Concrete)", publicly available since at least as early as Mar. 2004.

ABT, Inc.'s catalog entitled "Trench Former", Troutman, NC, 1994.

Page from ABT's website, www.abtdrains.com for PolySelf product entitled "Residential Surface Drainage System", understood to be publicly available at least as early as Mar. 2004.

Page from ACO's website, www.acoaus.com, entitled "ACO Drain—Modular Drainage System for all Applications", understood to be publicly available at least as early as Mar. 2004.

Page from Zurn's website, www.zurn.com, for "Flo-Thru™ Trench Drain Products", understood to be publicly available at least as early as Mar. 2004.

Page from McNichols website, www.mcnichols.com, entitled "McNichols® Trench Drain System", understood to be publicly available at least as early as Mar. 2004.

Page from J.R. Smith's website, www.jrsmith.com, entitled "Design Approach—Polymer Concrete and Fiberglass Surface Drainage Systems", understood to be publicly available at least as early as Mar. 2004.

ABT, Inc's "PolyDrain Installation Guide", Troutman, NC, Aug. 2000.

ABT, Inc.'s "PolyDrain Pre-Engineered Surface Drainage Manual", Troutman, NC, May 2001.

Product information sheet for "Zurn Z-806 6-inch wide presloped fiberglass trench drain system", available at least as early as Mar. 12, 2004.

Specifications sheet (Dwg. No. 58615) for "Zurn Z-806 6-inch trench drain Ssystem", available at least as early as Mar. 12, 2004.

Specifications sheet (Dwg. No. 57030) for "Zurn Z-812 12-inch trench drain system", available at least as early as Mar. 12, 2004.

Specifications sheet (Dwg. No. 57648) for "Zurn Z-824 24-inch trench drain system", available at least as early as Mar. 12, 2004.

"Flo-Thru Cross Reference Guide", Jan. 7, 2003.

J.R. Smith Mfg. Co's "Enviro-Flo® Trench Drain Series" catalog, Apr. 2003.

Pages from Aco Polymer Products "Aco Drain Systems Manual", 1990.

Pages from Polylok, Inc.'s catalog entitled "Innovations in Precast Drainage and Waste Water Products", understood to be publicly available at least as early as Mar. 2004.

* cited by examiner

TRENCH DRAIN FRAME AND GRATE ASSEMBLY

FIELD OF THE DISCLOSURE

This disclosure relates to trench drains and surface drains, and more particularly to a trench drain frame operable to be mounted to the top of a readily available drainage pipe, and a grate for engagement thereto.

BACKGROUND

There have been numerous designs of trench drains and floor drains over the years. These are typified by U.S. Pat. Nos. 5,529,436 (owned by the assignee of the present disclosure), 6,027,283, and 6,612,780. However, there remain certain disadvantages with such drains, particularly in the labor and expense required in initially forming and assembling the trench drain components prior to casting concrete around them for installation and use, and further, because the trench frame sections need to be directly connected to one another, i.e. joined end-to-end. The latter requirement prevents, in effect, any random placement of drains at separate locations. Additional problems with some trench drains include the needed levelling of one given section relative to an adjacent section, the need to frame up the trench drain for the pouring of concrete, and the need to assure the trench drain stays in place, i.e. does not float, while the concrete is being poured.

Additionally, there have been drains where an underlying drainage conveyance was formed to have no top portion, i.e. such a drain had an elongated opening in the top of the drainage conveyance when the latter was created, and a drain grate structure was associated with that opening. Such elongated opening-type drains are typified by U.S. Pat. Nos. 3,815,213; 4,490,067; 5,380,121; and 5,908,266. However, these prior elongated-opening drain devices had disadvantages. For example, they do not permit the grate structure (which usually sits atop the lower elongated-opening conveyance) to directly transmit loads placed on such grates to the surrounding concrete or earthen support structure. Instead, such grate-developed loading forces are placed directly on the underlying conveyance structures, causing them to be weakened. Further, some such prior devices require very convoluted and configured extrusion or injection molding designs, i.e. to create the interconnected upper surface grate and lower elongated opening drainage conveyance structure. Thus they are often costly, both from a mold-making and molding standpoint. They also do not permit use of a detachable drain grate member, for periodic removal of the drain grate to allow for any needed cleaning of the underlying drainage conveyance through the elongated opening.

SUMMARY

In one aspect, the present disclosure provides an elongated trench drain frame member, adapted to be fastened to the top of an underground drainage pipe member. The frame has a pair of generally parallel side wall members with connecting end plates at their respective ends, with the side walls operable to receive a separate drain grate member inserted therebetween. Each of the side walls also includes a base member with generally horizontally-extending outer and inner base walls, plus a downwardly-extending support wall operable to sit on the top of the underlying pipe. The outer base wall includes concrete gripping elements preferably in the form of a plurality of holes for receiving poured concrete to assist in retaining and supporting the trench drain frame within the poured concrete. A series of cross strut members for connecting and separating the two main side walls also help maintain the proper separation and parallel alignment of the side walls. Further, the cross struts are used for accepting self-tapping screw fasteners to mount the trench drain frame to the upper surface of the underlying pipe.

When needed in certain applications, the trench drain frame member can be cut to a desired shorter length. Then, a separate end plate member can be held by the trench frame, by tabs inserted in downwardly-extending channels carried by the inner base walls. In such manner, there is a connector end plate member present at each end, even with such a shortened trench frame member.

Advantageously, in another aspect of the disclosure, the trench drain frames can be assembled as desired to be in a series end-to-end abutting alignment, over the underlying pre-positioned drainage pipe. However, they can also be placed at aligned but spaced intervals along the underlying pipe, or at different random non-aligned locations connected by an underlying drainage pipe assembly. In this fashion, a single trench drain member can be provided in just one location, such as the low point of a poured driveway, or perhaps in the swale of a parking lot area, and this is the case, even though the underlying drainage pipe may then be connected at some other location, i.e. to another similarly situated individual trench drain frame member. The underlying connecting drainage pipe can then itself be drained, such as through the use of common pipe tees or other readily available drain pipe components to a separate pitched drain pipe.

Because the respective base walls are preferably directly supported by poured concrete or packed asphalt, or for some special applications, where this may be the only available material, supported in suitably tightly-packed crushed limestone, sand, gravel, or dirt, the overall trench drain frame and grate assembly of the present invention directly transmits all forces as seen by the grate to the poured concrete or asphalt (or other tightly-packed supporting material), rather than directly to the walls of the underlying drainage pipe. Additionally, because in one version of the disclosed trench drain, the cross tie members and top portion of the underlying pipe are all cut away and removed during formation of the trench drain, subsequent removal of the drain grate member allows ready access of the underlying drainage pipe for clean out purposes.

DETAILED DESCRIPTION OF THE PREFERRED EMBODIMENTS

Figure 1:
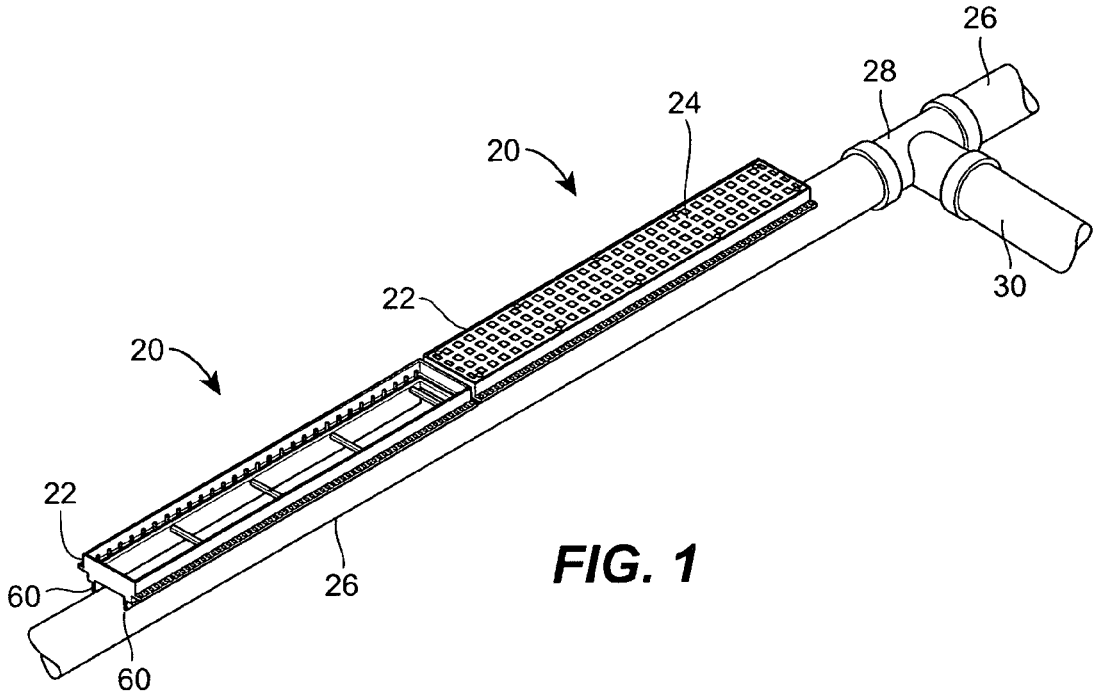
FIG. 1 is a perspective view of a pair of the trench drain frame and grate assemblies of the present disclosure, depicting associated underlying drainage pipe portions, and with one grate member removed.

There is shown in FIG. 1 a first aspect of the present disclosure in which the overall trench drain frame and grate assembly is generally denoted by reference numeral 20. Frame and grate assembly 20 includes an elongated trench drain frame 22 and an elongated grate 24. Assembly 20 is shown as longitudinally aligned and positioned over the top of an underlying drainage pipe 26 which, at the far right end (in FIG. 1), is connected to a commercially available tee-member 28, which in turn is fastened to a further drainage pipe section 26 as well as to a pitched drain pipe 30. Pipe 30 has sufficient pitch sloping away from the level of drainage pipe 26 to drain fluid from pipe 26. As seen, the left assembly 20 in FIG. 1 has had the grate removed (for better viewing) while the right assembly 20 includes the grate 24 fastened in place. Both assemblies 20 are positioned over the pipe 26, with the right assembly being already fastened down to the pipe (described below), while the left assembly remains to be so fastened.

Each trench drain frame and grate assembly 20 is an individual unit that can be assembled and used at a single location, or instead used with other such assemblies 20 in a series, end-to-end abutting arrangement, while other types of arrangements for locating an assembly 20 are described later herein. Further, the drainage pipe 26 can be formed from the commercially available well-known plastic drain pipes, such as those readily available and relatively inexpensive 4-inch smooth-wall drain pipes known as 4" SDR 35 pipe; 4" ASTM 2729 pipe; 4" Schedule 40 pipe; and 4" ASTM 3034 pipe, or even with corrugated pipe, for example. Alternatively, each frame and grate assembly 20 can be mounted to the tops of other commonly available pipes of other dimensions, such as pipes equivalent to the 4-inch pipes noted above, but instead being, for example, of a 3-inch diameter or even a 6-inch diameter, as desired.

Preferably, each of the trench drain frame 22 and grate 24 are formed of injection-molded plastic material, such as polyethylene. The grate could also be formed of polypropylene, while the trench drain frame could also be formed of polypropylene or PVC (polyvinyl chloride) materials. Such non-corrosive plastic materials, when so molded, have more than sufficient strength to handle the necessary loads that will be placed on the grate and frame, such as by the tires of heavy equipment rolling thereover, as described later herein. However, both the frame 22 and grate 24 could also be formed of a metal material, as appropriately sized, such as steel or cast iron.

Figure 2:
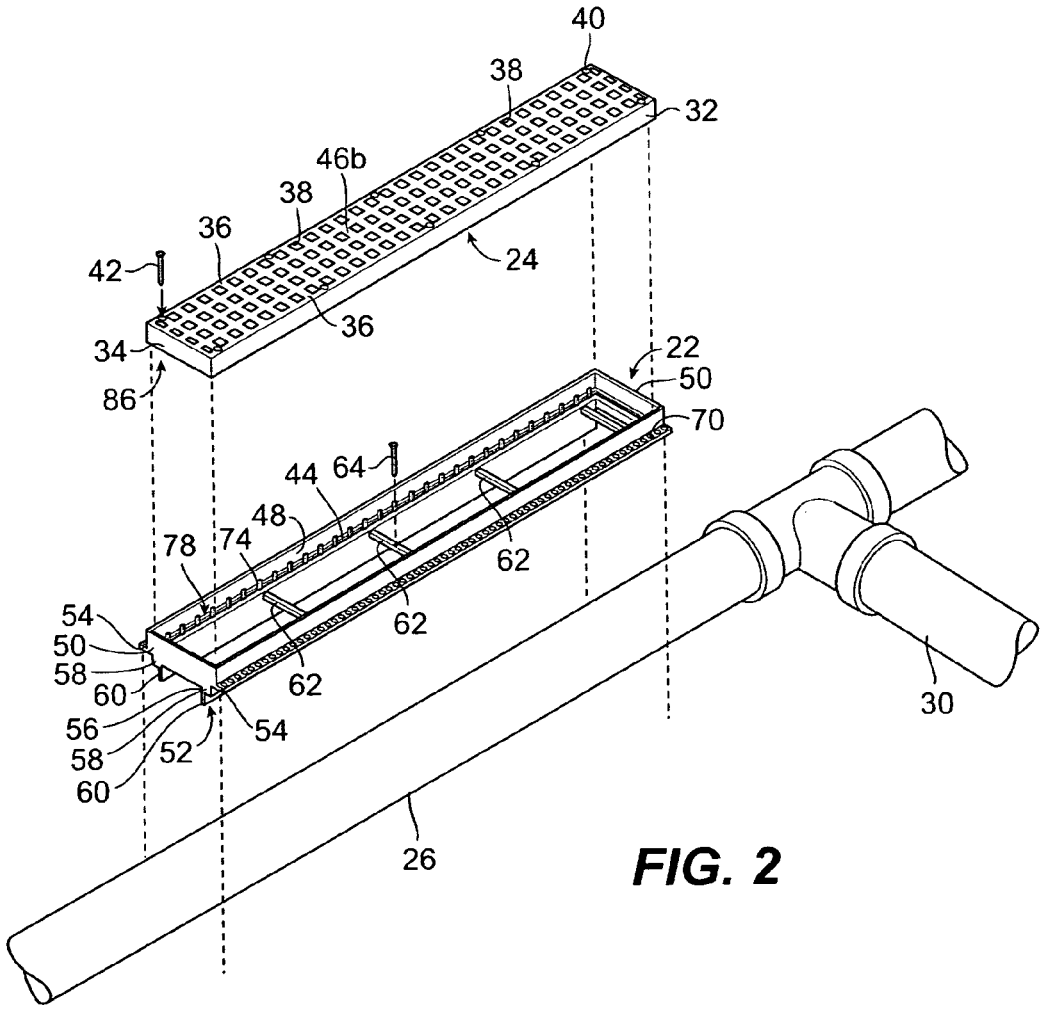
FIG. 2 is an exploded assembly view, in perspective, of the trench drain frame, grate, and underlying drainage pipe portions of FIG. 1.

FIG. 2 shows an exploded assembly view of how the grate 24 fits into the seat provided by trench drain frame 22, to create the overall assembly 20, which assembly is adapted to sit atop and seal against the underlying drainage pipe 26.

As seen, the grate 24 includes side walls 32, end walls 34 and an upper drain surface 36 comprising a plurality of drain openings 38 respectively formed by a latticework of cross-walls 46*b*. A plurality of fastener openings 40 receives respective fasteners 42 used to ultimately secure the grate 24 to the frame 22. The fasteners 42 extend into and secure to the channel 44 of frame 22.

Figure 5:
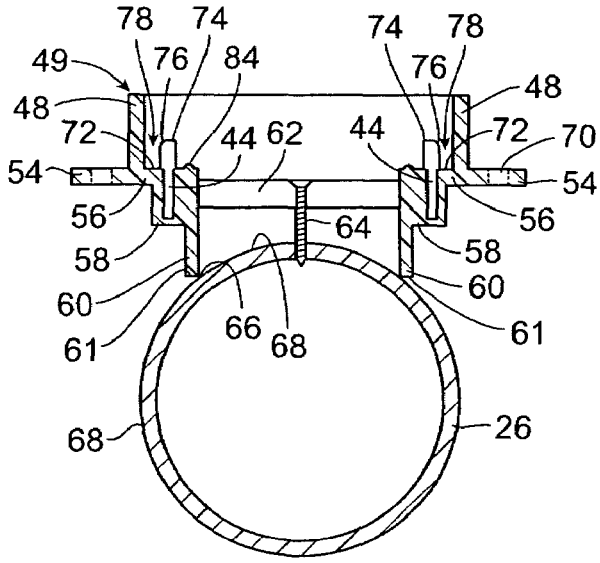
FIG. 5 is a cross section view of the frame, viewed along lines 5-5 of FIG. 3*c*, with drainage pipe connected to the frame.

Continuing with FIG. 2, the trench drain frame 22 includes frame side walls 48 connected at their respective ends by frame end walls 50. The respective frame side walls 48 are generally aligned parallel to one another. The lower end of each frame side wall 48 carries a base portion, generally denoted by reference numeral 52. The base portion 52 includes respective generally horizontally-extending outer base wall 54 and inner base wall 56. The inner base wall 56 includes at its innermost end a generally downwardly-extending trunk portion 58 with a further downwardly-extending generally vertically-aligned support wall 60. As will be noted (see FIGS. 1 and 5-6, for example), the lower ends 61 of the respective downwardly-extending support walls 60, including particularly the inner corners 66, are adapted to rest on and seal along the underlying drainage pipe 26, whereby the walls 60 support the trench drain frame 22 on top of the pipe 26. Further, the fact that the respective inner corners 66 directly rest on and are pressed against the wall of pipe 26 helps to create a seal or barrier, in effect, against entry of the later-poured concrete along that area, such that concrete can't enter into the area in between the support walls 60.

It will be understood that the support walls 60, and the inner corners 66, can alternatively be formed in different shapes, and be aligned in other configurations, including non-linear shapes such as curved, stepped, and right-angled, for example; or be formed of greater or lesser length dimension; or be formed at an angled alignment relative to inner base wall 56, for example; and yet all would still effectively function to sealingly support the frame 22 on the pipe 26. The only requirement is that the support walls 60, and especially the corners 66, whatever their shape, substantially seal off against the pipe, so as to best create a barrier to keep the later-poured concrete outside of wall 60, and none on the inside of wall 60.

At periodic locations along the length of the elongated trench drain frame 22, and integrally fixed at their respective ends into the respective support walls 60, are a series of cross-tie members 62. Cross-ties 62 help maintain the desired spacing between and parallel alignment of the respective support walls 60, and hence, of the respective inner base wall 56, and the respective frame side walls 48. Self-tapping fasteners 64 (see FIGS. 2 and 5-6) are used to connect the respective cross-tie members 62, and hence the overall trench drain frame 22, to the top of the underlying drain pipe 26, whereupon (see FIGS. 1 and 5-6) the inner corners 66 of the support walls 60 sealingly engage the upper region of the outer surface 68 of the drain pipe 26.

Turning to FIGS. 2, 3*a*-3*c*, and 4-6, it is seen that the respective outer base walls 54 of frame 22 are formed with a plurality of concrete-gripping elements in the form of throughholes 70, the use for which will be described later herein. Further (see FIG. 3*b*), the cross-tie members 62 are preferably formed as open-bottomed channel sections. The upper surface 72 of inner base wall 56 is formed with channels 44, which as noted before, are adapted to ultimately receive the threaded fasteners 42 holding the grate 24 to the trench drain frame 22. Further, channels 44 include a plurality of spaced, upwardly-extending positioning teeth 74, which on their upper outward respective edges have a curved corner 76. In use, when the grate 24 is forcibly pounded down to seat tightly within the frame 22, the grate side walls 32 are forced, via curved corner 76 and the positioning teeth 74, to fit tightly down within the spaces 78 created to accept the grate side walls 32. That is, when the grate 24 is placed over and forced onto the frame 22, the positioning teeth 74 tend to forcibly draw into correct position the frame side walls 48, should the same be at all bowed out or otherwise not be in aligned parallel spaced relationship to the other respective frame side wall 48.

As discussed later herein, it is important during installation, when trench frame 22 is fastened to pipe 26, such that pipe 26 and trench frame 22 are in the ground, that the grate 24 is frictionally held in place in the trench frame 22, before the concrete is poured. Thus, the tightly formed spaces 78, which exist between the positioning teeth 74 and frame side walls 48, permit the grate 24 to be forcibly placed in correct parallel and spaced alignment, and to remain there under an interference fit, so that the fasteners 42 are not needed (until final assembly) to retain the grate 24 in place over the frame 22. This causes the grate 24 to help keep the frame side walls 48 in correct registry to one another, i.e. correct respective alignment. That is, this action brings walls 48 into right angle alignment, relative to grate 24, so walls 48 are not canted in or out, but are generally upright.

Figure 3A:
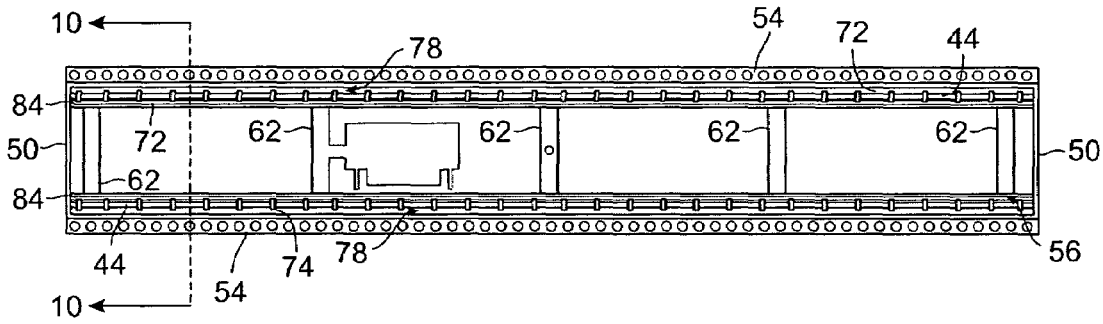
FIG. 3*a* is a top plan view of the trench drain frame of FIG. 1.
Figure 3B:
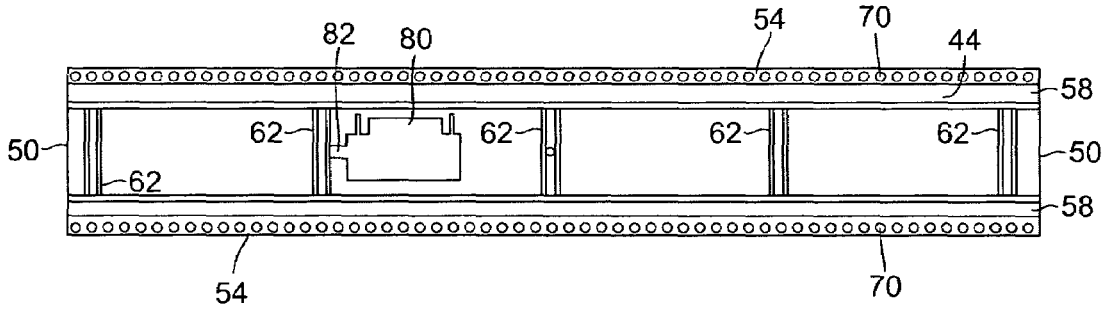
FIG. 3*b* is a bottom plan view of the frame of FIG. 3*a;*
Figure 3C:
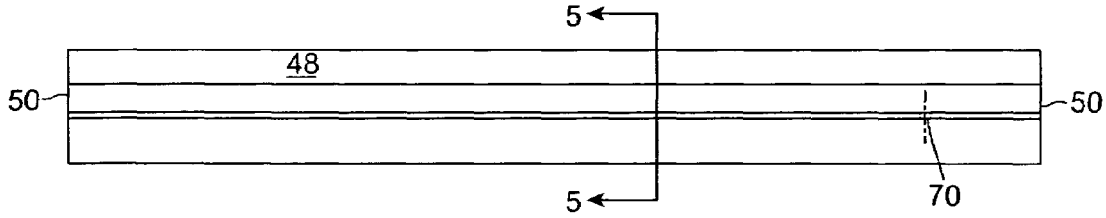
FIG. 3*c* is a side elevation view of the frame of FIG. 3*a;*
Figure 4:
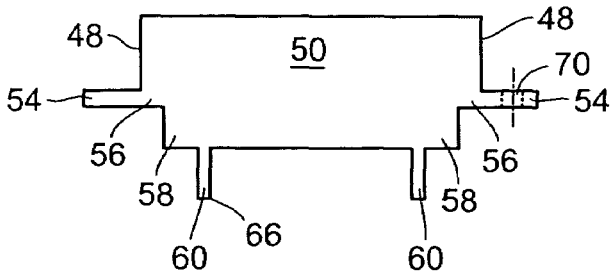
FIG. 4 is an end view of the frame.

As seen in FIGS. 3*a* and 3*b*, a separate end plate 80 is formed, as integrally held in place by tab 82 (as connected to a cross-tie 62) when the trench drain frame 22 is initially formed, such as by injection molding. Also, an extended raised rib 84 (see FIGS. 3*a* and 5-6), extends upwardly from each of the inner base walls 56, and is present to properly position, i.e. vertically locate, the lower edge 87 of the various crosswalls 46 of the grate 24, relative to the lower edge of each wall 48, when the grate is forcibly seated in the frame 22. In that fashion, the rib 84 acts to assure proper vertical alignment of the top of grate 24 relative to the top of the respective frame side walls 48 (see FIG. 6). This is also important because during injection molding, the bottom edge 87 of cross walls 46 tend to shrink and arch upwardly (see FIG. 6). Hence, the presence of rib 84 allows those walls 46 to seat correctly, as the ribs' height takes up the shrinkage slack at that point. In effect, outside wall 48 bottoms out on upper surface 72, and crosswall lower edge 86 bottoms out on rib 84.

Turning to the on-site installation of the present trench drain frame and grate assembly 20, it is understood that the most common and advantageous labor-saving use would be to make the needed trenches in the ground, fill them to the desired levels with gravel, and then lay out and connect into a rigid framework the needed arrangement of all of the various drainage pipes 26, tees 28, and pitched drain pipes 30. The gravel and various pipes would be purposely so levelled and positioned so that the tops of the respective frame 22 and grate 24 will be at the desired surface level, i.e. such as 2-½ inches above the top of the drainage pipe 26, in one embodiment made in accordance with the present disclosure. Once that rigid piping system layout is formed, respective ones of the present frame and grate assembly 20 can be securely fastened to the top of the pipes 26, at the specific separate locations where desired. Thereafter, concrete is poured abut the entire layout, so that the trench drain frames are properly surrounded and supported by concrete. In this way, because the connected piping system that frame 22 screws to acts as the bracing for the frame, and hence, no special bracing or forming is normally needed for pipes 26 or frame and grate assemblies 20. That is, frame and grate assembly 20 as attached to the pipe 26 does not need any special support before pouring of the concrete.

Alternatively, and depending on the needs and end-use of the actual installation involved, such as for heavy duty use, the assembly 20, and attached pipes 26 can instead be formed and fastened to raised up stakes, metal bars or posts and the like, before pouring the concrete. That way, concrete is present under the pipes also, much like a footing below the trench drain assemblies 20. Further yet, where desired, such as for light duty driveway and perhaps landscaping use, assuming the piping layout is first laid out on a sufficiently secure base, the pipes with attached assemblies 20 can be under-supported by suitably, well-packed asphalt material, gravel, crushed limestone, sand, or even dirt. However, regardless of how installed, the pipes 26 and each assembly 20 must be resting on a secure base to properly function.

Figure 6:
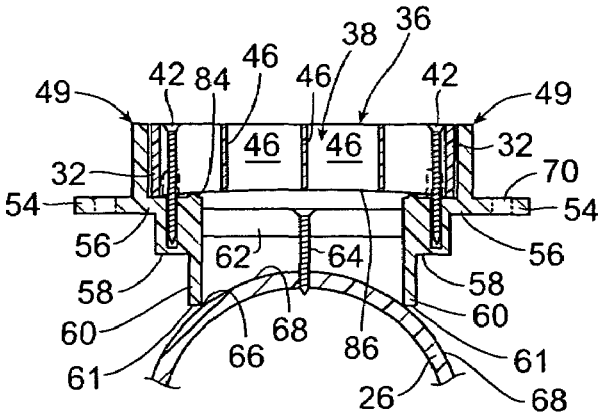
FIG. 6 is a partial cross section view of the frame, similar to FIG. 5, and depicting the attached grate and fastener members.
Figure 7A:
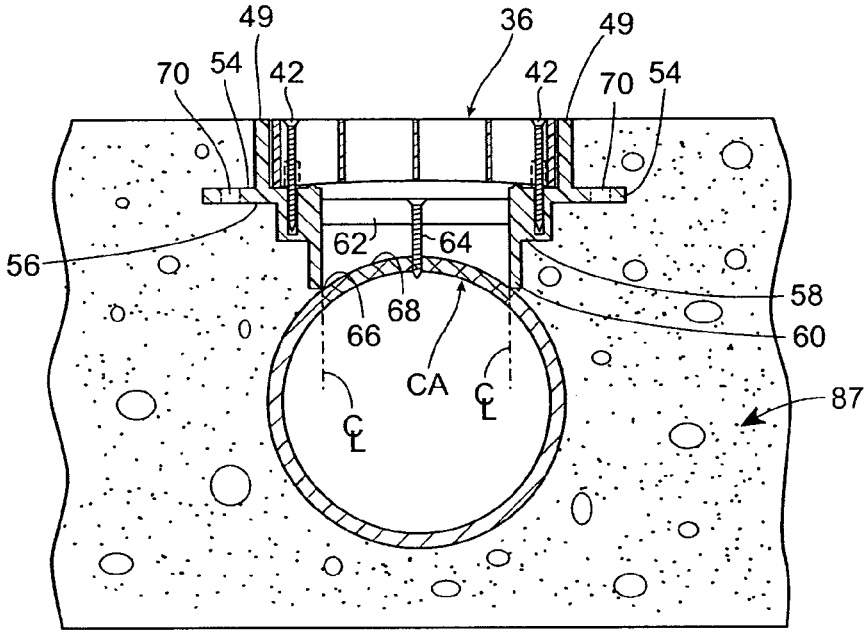
FIG. 7*a* is a cross section view, similar to FIGS. 5 and 6, with the grate present and depicting the surrounding poured concrete.

Thus, turning to FIG. 6, it is seen that the trench drain frame and grate assembly 20 is now positioned above the top of the underlying pre-positioned drainage pipe 26, such that the fasteners 64 have penetrated the pipe 26, thereby holding the frame 22, via cross-ties 62, down to the pipe 26, such that the inner corner 66 of the lower end 61 of each of the lower support walls 60 is in direct sealing contact with the outer surface 68 of pipe 26. In that condition, assembly 20 is positioned on top of, and now firmly held in place against, the pipe 26. In this fashion, the overall assembly of pipe and trench drain frame and grate assembly 20 is properly positioned in the location needed, such as on a bed of gravel in the ground (not shown), all so as to be ready for pouring of concrete about the overall assembly. Alternatively, as explained, the pipe 26 and attached assembly 20 could be formed up with wood stakes, metal reinforcement bar sections or posts, or other components. Further, the needed pitched drain pipes 30 have already been fastened to the underlying drainage pipes 26. All such pipes can be chosen from readily available common plastic drain pipes (smooth wall or corrugated). Thereafter, the concrete 87 is poured and allowed to harden, with FIG. 7*a* depicting the resulting arrangement. In that case, as seen, concrete 87 has completely enveloped the trench drain frame 22 right up to the level of the upper surface 49 of the frame side walls 48, and hence up to the upper edge 36 of grate 24.

Additionally, concrete 87 flows to and enters the areas above the outer surface 68 of pipe 26 but under the respective outer and inner base walls 54, 56 of frame 20, as well as under trunk portion 58 and also up against the outside (but not inside) of support walls 60. Thus, once cured, the poured concrete 87 directly presses against, and thus supports the trench drain frame 22. Further, concrete 87 penetrates and is captured within the various concrete-gripping elements shown as throughholes 70 formed along the outer base walls 54. It will be understood that other structures, rather than the throughholes 70, can be similarly used for the concrete-gripping elements, not shown, such as outwardly extending posts or nubs formed along outer base wall 54, or dimples along one or both of the top and bottom of the outer base wall 54.

Figure 7B:
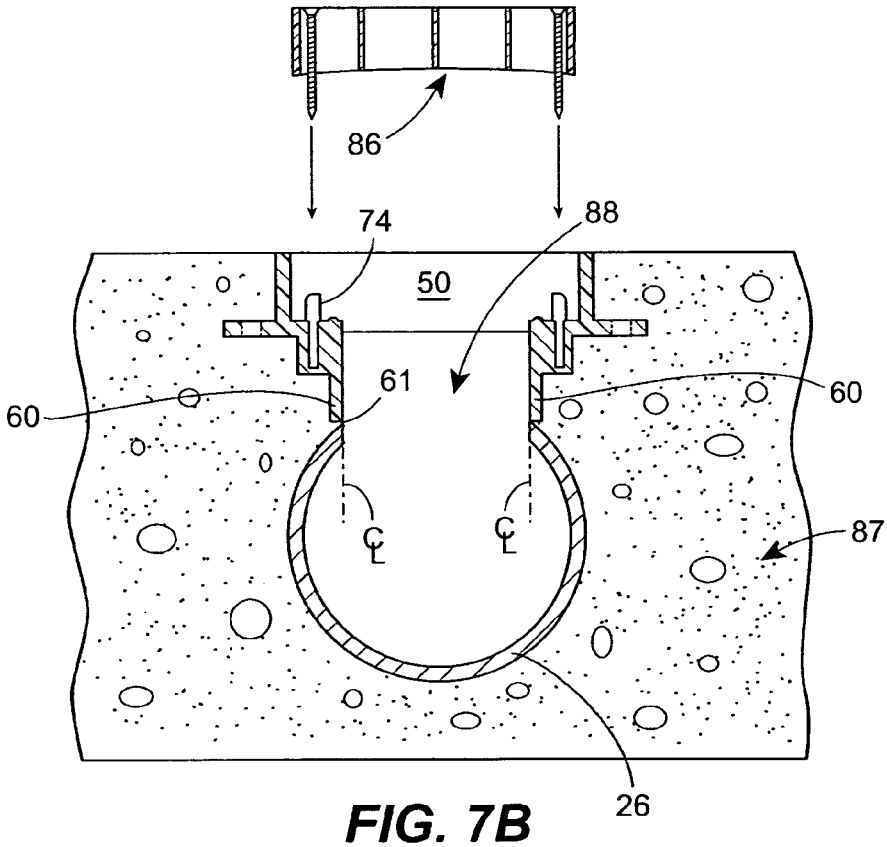
FIG. 7*b* is a cross section view, similar to FIG. 7*a*, but with the grate removed, and the cross-ties and top-of-pipe portion cut away and removed.

As seen in FIGS. 6, 7*a* and 7*b*, at this stage of installation, fasteners 42 are not yet needed, since the grate 24 is forcibly fit to and seats tightly within the frame 22. Thereafter, the grate 24 is removed (see FIG. 7*b*), to expose the pipe's top portion (see uppermost segment of pipe 26, designated by reference letters CA in FIG. 7*a*). Because the grate 24 has been removed, the installer can utilize a suitable saw, e.g. a reciprocating saw or other type saw, to literally cut away through the side wall of pipe 26, and then remove the uppermost slotted pipe segment CA, as well as each of the respective cross-tie members 62 (and hence the respective fasteners 64), with such saw cuts being made generally longitudinally along and just inside of the respective support walls 60 (generally along cut lines CL in FIG. 7*a*). The resulting cut away drainage pipe 26 is shown in FIG. 7*b*. As seen there, any fluids, e.g. run-off water being drained to and entering the grate area 24, then flows down across the upper surface 72 of inner base wall 56, and down along the support walls 60, entering the new slotted opening 88 formed in the underlying drainage pipe 26. In that fashion, liquid entering the interior of drain pipe 26 via slotted opening 88 is carried away from pipe 26 by the respective pitched drain pipes 30. Advantageously, by preferably using round conventional plastic drainage pipe, the resulting flow channel for the newly-formed trench drain is round, not square or rectangular like present with known prior art trench drains. This is helpful as round flow channels achieve better flow characteristics than other flow channel shapes, since the round flow channels produce less side wall friction drag to the drained fluid.

The grate 24 is then securely fastened back in position, via fasteners 42, to the trench drain frame 22, and installation is thus complete.

Figure 7C:
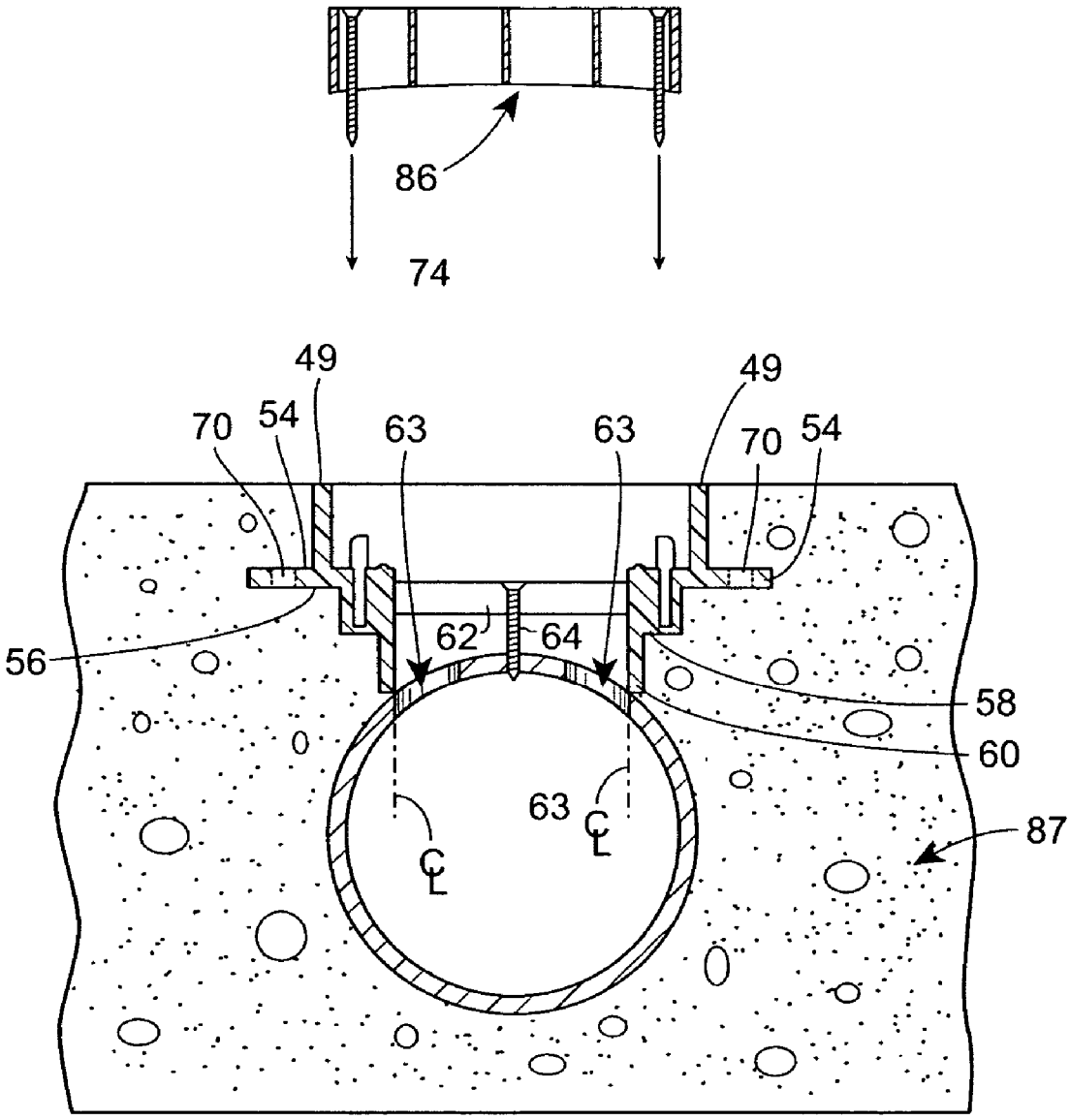
FIG. 7*c* is a cross section view, similar to FIG. 7*b*, of an alternate arrangement for using the trench drain, with grate removed, and a series of drain holes formed in the top portion of the pipe.

FIG. 7*c* depicts an alternate arrangement of this disclosure, namely an alternate way of creating the openings in the top of the pipe 26, i.e. to allow fluids to flow into that pipe. That is, instead of sawing out or otherwise removing the slotted pipe segment CA, the installer forms a series of openings 63 through the top of pipe 26 along each support wall 60. The cross-ties 62 are preferably removed, such as by sawing, so that they do not disrupt fluid flow below the grate 24 and above the pipe 26. (However, if desired, the cross-ties can be left in place.) The resulting series of through holes 63, for example, formed to preferably be generally 6 inches apart and from approximately ⅜ inch to 1 inch in diameter, allow the water flow to go through the grate 24, flow through the openings 63 at the lowest points along each side of the top of the pipe 26, and into the interior of pipe 26. Once the holes 63 are formed, the grate 24 is then securely re-installed, and this alternate arrangement of FIG. 7*c* operates like the preferred arrangements of FIGS. 7*a* and 7*b*.

It will be noted that, when heavy loads are applied to the upper ends of the frame side walls 48, and to the grate 24, such forces are transmitted, collectively via outer base wall 54, inner base wall 56, trunk portion 58, and side wall 60, directly to the poured concrete 87 present underneath such elements and supporting the same. Advantageously, very little, if any, such forces are transmitted (such as via corners 66 of support walls 60) to the edge walls of the underlying drainage pipe 26. Plus, contrary to the prior art ground surface drains that are formed with open pipe tops or elongated opening-type conveyances, no substantial external load forces are directly transmitted to the relatively weak pipe structure. Instead, with the present trench drain frame and grate assembly 20, substantially all of the load forces seen by the frame side walls 48 and grate 24 are transmitted directly to the poured concrete 87. Thus, the trench drain frame and grate assembly 20 is able to withstand substantial external loading on the frame 22 and grate 24 without damaging the underlying pipe 26. In one load test of a trench drain and grate assembly 20 made and installed to form a trench drain in accordance with the present disclosure, such loading amounted to more than sufficient capacity to handle heavy rubber tired machines and other heavy loads rolling over the drain, such as would be generated by fork lift trucks, heavy equipment trucks, and so forth.

Figure 8:
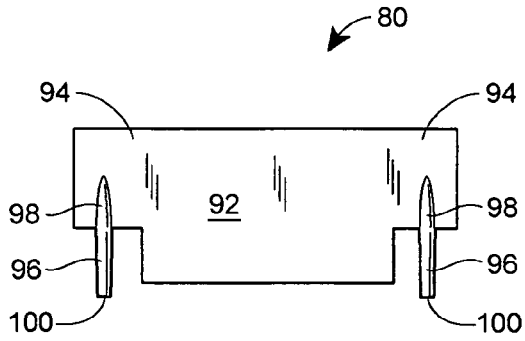
FIG. 8 is a top elevation view of an extra end plate member.
Figure 9:
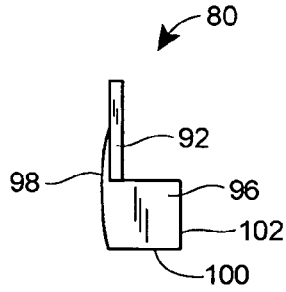
FIG. 9 is a side view of the end plate member of FIG. 8.
Figure 10:
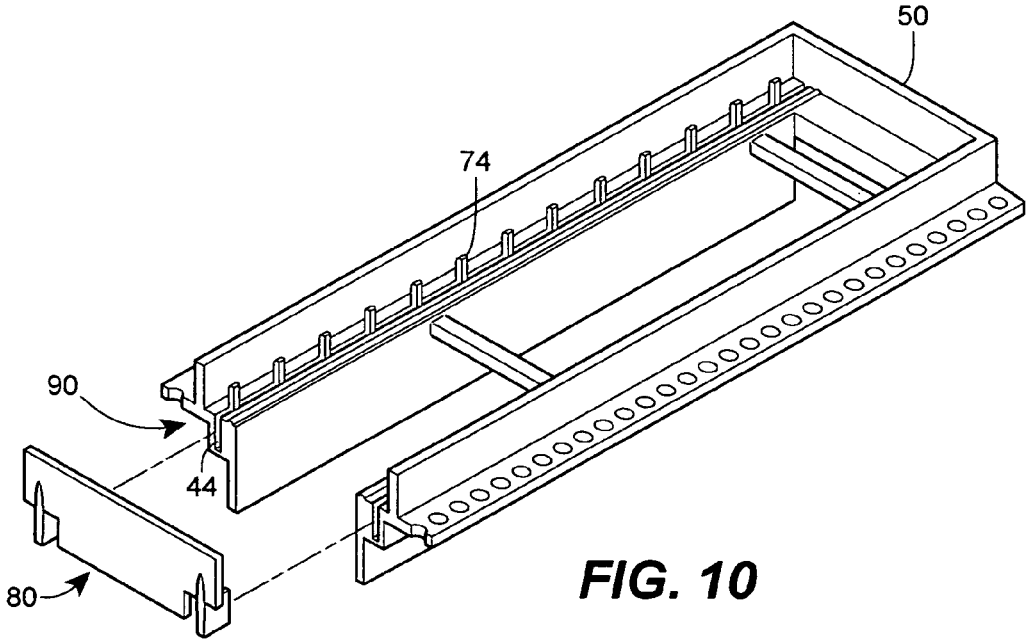
FIG. 10 is a perspective view of a trench drain frame that has been cut short, with an extra end plate member installed.
Figure 10A:
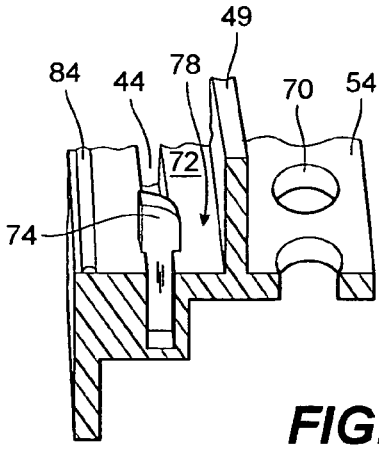
FIG. 10*a* is an enlarged fragmental view of a portion of the trench frame, to better show various components.

Turning to FIG. 10, there is shown a frame 22 that has been cut somewhat short at its left end so as to expose the same (see cut made generally along reference line 10-10, for example, in FIG. 3*a*). In FIG. 10, the separate end plate 80 has been removed from the cross-tie 62 (see FIG. 3*a*), and inserted into the opened left end 90 of the shortened frame 22. More specifically, as seen in FIGS. 8 and 9, the separate end plate 80 includes a main body portion 92 having outboard wing segments 94, each carrying transversely aligned connector tabs 96 integrally fastened, via thickened support portions 98, to the wing section 94. The free end 100 of each of the respective tabs 96 is forcibly inserted into the respective channels 44 of the inner base walls 56 of frame member 22. In this fashion, the separate end plate 80 is securely retained, in its proper end plate position, on the now-cut open end 90 relative to frame member 22. As so mounted to frame 22, the separate end plate 80 operates the same as the integral end plate 50 found at the other end (rightmost end in FIG. 10), i.e. to keep the concrete 87, when the same is being poured about the properly positioned and framed up trench frame 22, from getting into the interior of frame 22, and to maintain the proper spacing of the frame side walls 48 at that end of frame 22. When cutting frame 22, so as to shorten the same and create the open end 90, to then receive the separate end plate 80, care must be taken to provide sufficient room for the length (see FIG. 9) of the respecting tabs 96 which need to be inserted within channels 44. That is, looking at FIG. 3*a*, care must taken that the cut line 10-10 is formed close to the inside surface of the respective positioning tooth 74, so that a sufficient open length of channel 44 remains, to thereby fully accept the length of the inserted tabs 96, such that the leading ends 102 of tabs 96 do not engage the next adjacent positioning tooth 74 within channel 44. Thus, as seen in FIG. 10, the trench drain frame in overall assembly 20 the present invention can be cut to length, i.e. shortened to fit the available space. Then, through use of the separate end plate 80, and with the associated grate 24 correspondingly cut to the same shortened length, a modified trench drain frame and grate assembly 20 can be created, in a given application, to be used in the same manner as with the full-length assembly 20 of the present invention.

Figure 11:
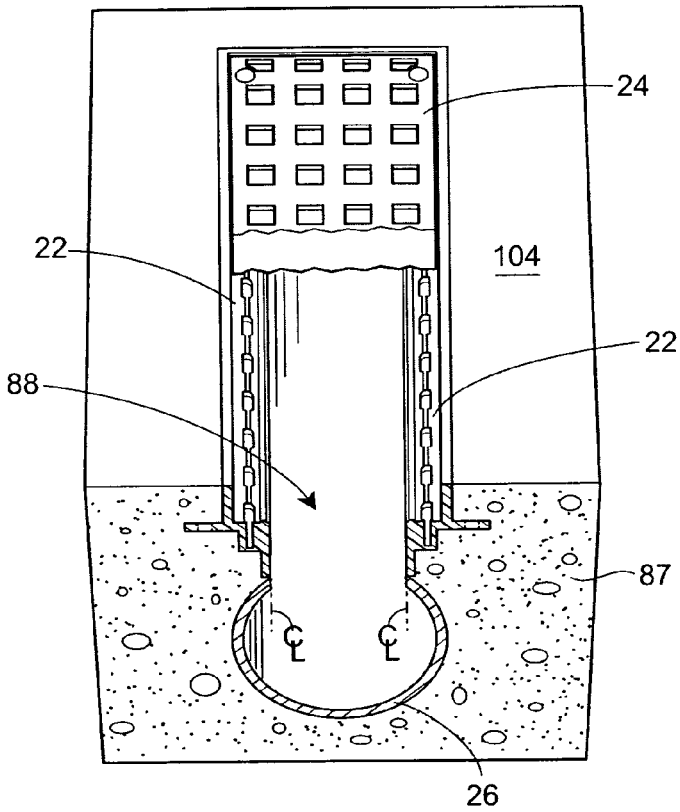
FIG. 11 is a top front perspective view of the trench drain frame and drainage pipe poured in concrete, similar to FIG. 7*b;*

FIG. 11 depicts a perspective view of an assembly 20 that has been cast in place in concrete 87, and depicting the frame 22 and grate 24 (which has been partially broken away for better viewing). As seen, water can drain across the top surface 104 of the poured concrete 87, then through the grate 24 down through the cut away slotted opening 88, and hence, drain through pipe 26 until reaching a suitable pitched drain pipe (not shown in that Figure, but see pitched pipe 30 in FIG. 10). Then, once the grate 24 is removed, debris in the drain pipe 26 can be easily cleaned out as needed, in view of the available direct access to the inside of pipe 26 by way of the elongated drain opening 88 formed in the top of the pipe 26.

Turning to the present method for installing a trench drain frame and grate assembly so as to form a trench drain, it includes the following:

a) Laying out, at the correct location and desired height, within a trench network, and as formed of commonly available drainage components, the required arrangement of drainage pipes, elbows, Tees, and pitched drain pipes, for the drainage area involved.

b) Fastening at least one trench drain frame member to the piping arrangement, by fastening it to the top portion of a selected drainage pipe in the arrangement, with such fastening accomplished, for example, by use of self-tapping screws 64 holding the cross tie member 62 against the top portion of the pipe 26;

c) Keeping the trench drain frame side walls 48 in aligned registry, by seating the grate 24, i.e. by forcibly pounding the grate into the frame 22, such that the respective grate side walls 32 are tightly fitted between the frame side walls 48 and respective positioning teeth 74;

d) Pouring concrete, or packing asphalt, crushed limestone, sand, gravel, or dirt (i.e., digging the assembly 20 into the soil) to fit around the assembly made up of the pipe, trench frame, and grate to the level of the top of the grate and frame, and allowing the poured concrete or packed material to substantially cure or otherwise become stabilized;

e) Removing the grate;

f) Creating an elongated opening in the top of the pipe, such as out a top portion of the pipe, and sawing or otherwise cutting through cross tie members of the trench drain frame, and then removing that cut-out top portion of the pipe, thereby exposing the pipe's interior for drainage purposes;

g) Reinstalling the grate to the trench drain frame, including fastening the grate down with fasteners, to complete the assembly.

Alternatively, as to step f) above, instead of preparing an elongated slotted-type opening in the top of the pipe, a series of separate openings can be formed through the pipe, plus removing the cross ties (or leaving them if desired), to create openings into the pipe's interior for drainage.

It will be understood that smooth-walled or corrugated pipe can be used as the pipes of the commonly available drainage components of step a) above. Additionally, instead of pouring concrete or packing suitable supporting material for step d) above, one can use, for example, so-called paver bricks or patio blocks to hold down and secure the trench drain frame, grate, and associated drainage piping arrangement.

Figure 12:
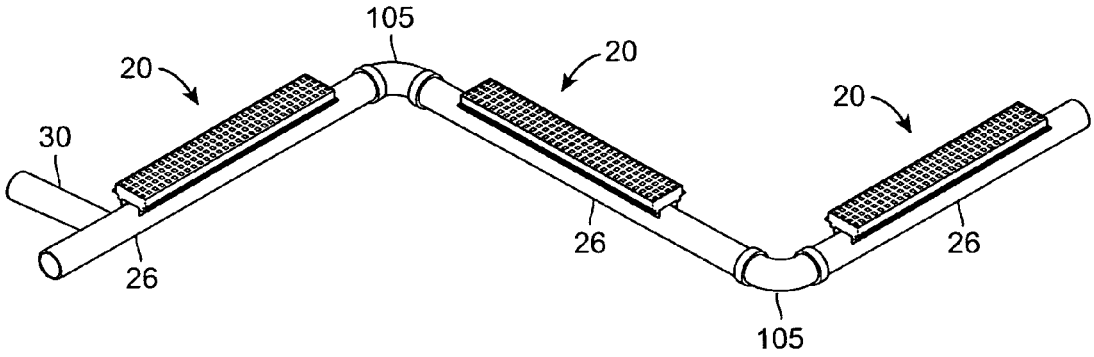
FIG. 12 is a perspective view of an alternate arrangement for the trench drain frame and grate assembly of the present disclosure, depicting trench drain frames and grates located at separated positions along a common underlying drainage pipe.

Turning to FIG. 12, there is depicted, as another aspect of this disclosure, an alternate arrangement for using the trench drain frame and grate assembly 20 described herein. In this case, instead of being installed on the underlying pipe in series arrangement, like that shown in FIG. 1, here individual trench drain and grate assemblies 20 are arranged in distinct isolated, i.e. separated, positions along a commonly connecting drainage pipe 26. For example, the pipe 26 is formed into three separate segments as connected by elbows 105, and with the pitched drain pipe 30. However, in this case, instead of the trench drain frame and grate assemblies 20 being placed in a series, end-to-end arrangement, they are installed at separate positions on the respective pipe sections 26 which pipe sections 26 themselves are formed at generally right angles to one another. Thus, through the present apparatus and method, the trench drain frame and grate assembly 20 can be each used as a series, end-to-end drain, or as a separate unit of a trench drain as positioned at isolated points along common underlying drainage pipe 26. In either arrangement, the pipe 26 can be separately drained via a pitched drain pipe 30. Thus, due to the use of a trench drain frame over a common inexpensive drainage pipe, each individual trench drain frame and grate assembly 20 can be placed at the specific separate positions, such as the front of the exit door next to a garage, or along the front of the garage, and/or in a pull out parking area of the same driveway that connects with the garage, for example. Other such isolated installation applications for the present drain frame and grate assembly 20, as all connected by the same underlying drainage pipe 26 or even by separate pipes, are easily created.

Figure 13:
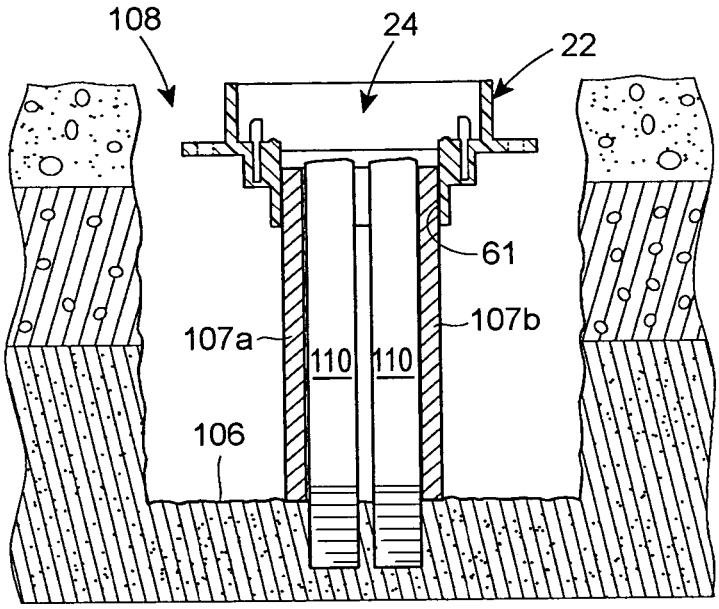
FIG. 13 is a cross section view of the present trench drain frame, when being installed in an alternate method.
Figure 14:
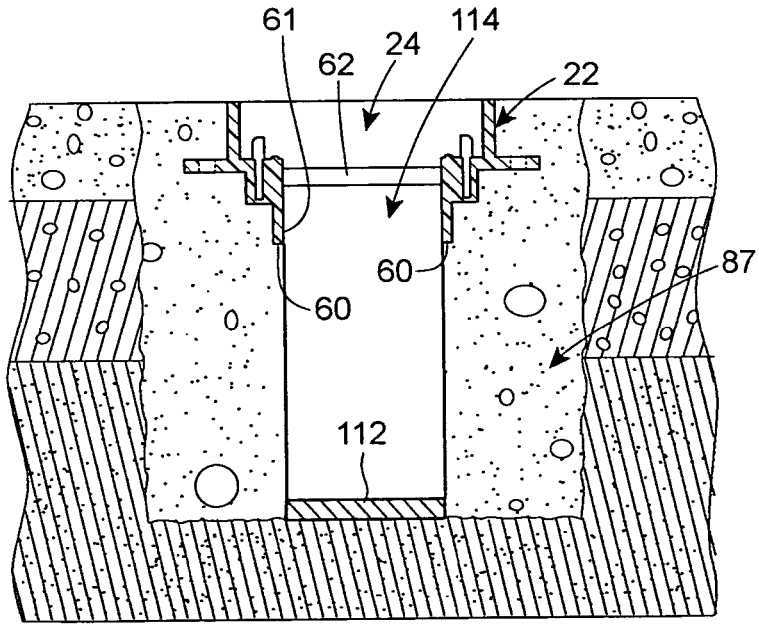
FIG. 14 is a cross section view, similar to FIG. 13, but at a later stage of installation.

In FIGS. 13 and 14 are shown an alternate method of installing and using the trench drain frame and grate assembly 20 of the present disclosure, this method being without need of any underlying drainage pipe 26. That is, FIG. 13 depicts a trench drain frame 22 having its various cross ties 62 rest on the top of respective form panels 107*a*, 107*b*, which also are respectively pressed against the inner surfaces 61 of the downwardly-extending support walls 60 of frame 22. The lower ends of the panels 107*a*, 107*b* rest on the bottom 106 of a trough 108 cut in the ground, the panels being so formed that the top of the grate 24 and frame 22 is positioned at the correct final height needed for that given drainage installation. At least one stake 110 is driven into the earth between the panels 107*a*, 107*b*, to forcibly hold the panels in a generally vertical alignment, and to forcibly press the panels against the respective surfaces 61 of support walls 60. In one embodiment of this alternate method made in accordance with this disclosure, the distance between surfaces 61 was approximately 3 inches, due to selected length for cross ties 62, the panels 107*a*, 107*b* were formed of plywood measuring sixteen (16) inches by eight feet by one-half inch, and the stake 110 was formed of wood (so as to snugly fit between the panels 107*a*, 107*b*). If the cross ties 62 were instead 6 inches long, then the distance between surfaces 61 would be approximately 6 inches. The stakes 110 alternatively could be formed as wood 2×4s, arranged to be fastened to alternate panels 107*a*, 107*b*. Also, depending on the slope desired to be given to the trench bottom 112, the panels 107*a*, 107*b* could range in height from between approximately 12 inches to 48 inches, and even more, as determined in the field. Concrete 112 is then poured to fill the void left between the wall of trough 108 and outer walls of panels 107*a*, 107*b*. That first pour of concrete then, once cured, encompasses the base portion 52 of frame 22, and is entrapped within the trough holes 70 (not seen in FIGS. 13 and 14, but see FIG. 7*a*), such that the frame 22 is now rigidly held in place and supported by the underlying concrete. Thereafter (see FIG. 14), the cross ties 62 are cut away, along the respective surfaces 61, the stakes 110 and panels 107*a*, 107*b* are removed, and a second pour of concrete is made, and cured, to form a sloped bottom wall 112 of the resulting concrete trench 114. (Note that with such a slope for bottom wall 112, no separate drainage pipe 26 is needed. For example, the slope of bottom 112, in a 100-foot run, could vary from 4 inches to 24 inches. The grate 24 is then forced into the frame 22, and fastened down via threaded fasteners.

Figure 15:
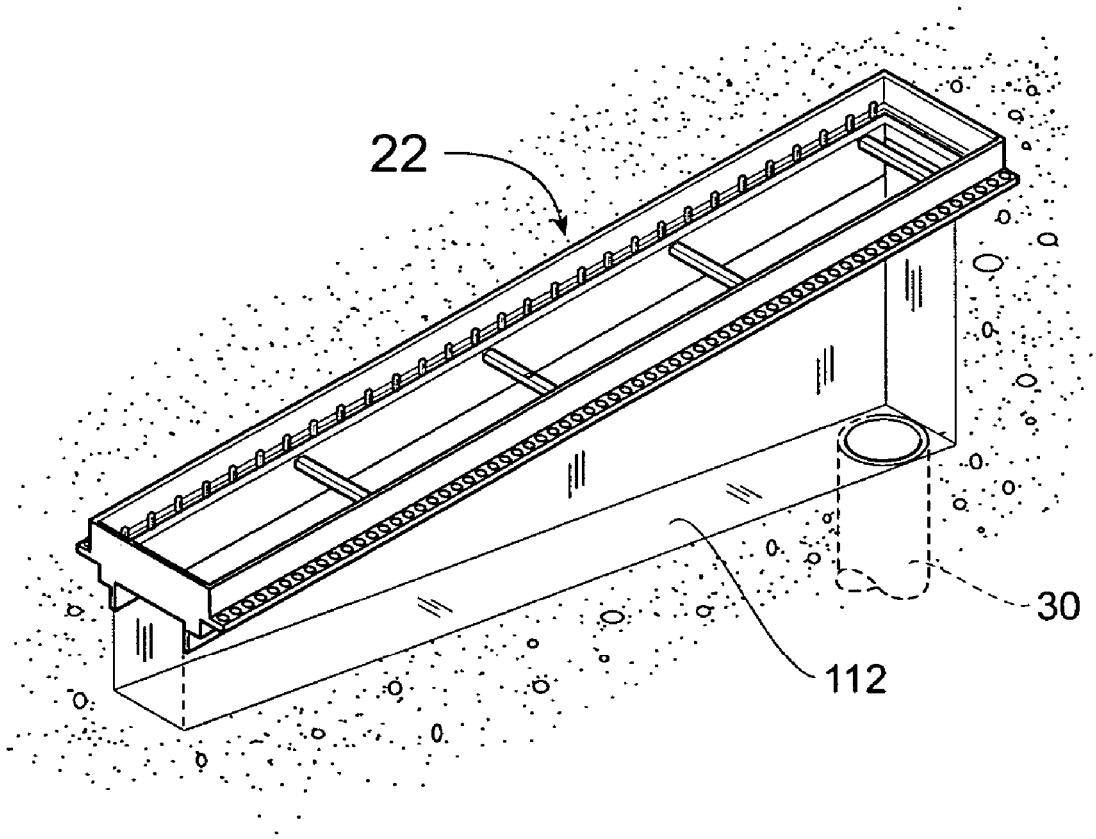
FIG. 15 is a side elevation view of the alternate arrangement of the trench of FIGS. 13 and 14, as having a sloped bottom and depicted with an end drainage pipe.

As seen, this alternate method of forming a trench drain, by using the trench drain frame and grate assembly 20 of the present disclosure, uses a poured concrete trench, rather than a drainage pipe 26, to carry the fluid collected within the trench drain frame and grate assembly 20. Nevertheless, a pitched drain pipe 30 can be used (see FIG. 15), if desired, to drain away fluid from the end (or any other location along) trench 114. This alternate process, using just the trench drain frame and side form panels plus a series of anchoring stakes, eliminates the need to have specialized reinforcement rod uprights or other structures to hold any metal angle iron trench edges in place, or the need for any large central core, i.e. foamed core pieces, when pouring the trench. This alternate arrangement can also permit the use of a slope for the bottom 112, ranging for example, from 4 inches below the grate to say 24 inches below the grate in a 100-foot run of trench assemblies, without the need (as desired) for any intermittent drainage pipe 30 save at the lowest end point of the sloped bottom 112.

The foregoing detailed description has been given for clearness of understanding only, and no unnecessary limitation should be understood thereof, as modifications will be obvious to those of ordinary skill in the art that are within the scope of the appended claims.

I claim:

1. A trench drain apparatus comprising:

a trench frame member adapted for mounting to an underlying drainage pipe and having generally upright parallel one-piece side frame members connected at their respective ends by end plate members and defining the top and the bottom of the trench frame member, each side frame member having a base wall member and support wall, the base wall members disposed between the to and the bottom of the trench frame member and extending generally transverse to the respective side frame members, portions of the base wall members adapted to be embedded in a support material formed about the trench drain apparatus and the drainage pipe to thereby support the trench frame member within the support material above the drainage pipe, the support walls extending downward from the base wall members to define side frame members having stepped cross-sectional profiles, the support walls having free ends that define the bottom of the trench frame member, the free ends of the support walls spaced apart and adapted to engage a portion of the drainage pipe; and a grate member seatably engaged in the trench frame member between the side frame members.

2. The apparatus of claim 1, and a plurality of cross tie members connecting the side frame members along the length of each of the side frame members.

3. The apparatus of claim 1, and the grate member having side walls, and the side frame members including a plurality of teeth members extending upwardly adjacent the base wall member, wherein the grate member side walls are respectively releasably received between the teeth members and the side wall of the side frame members to thereby retain the grate to the trench frame member.

4. The apparatus of claim 1, and an insertable end plate member operable, when the trench frame member is desirably cut at a shortened location between the end plate members, to be mounted to the trench frame member to close off the cut end.

5. The apparatus of claim 4, wherein the insertable end plate member is detachably connected to at least one of the side frame members so as to be readily available for use.

6. The apparatus of claim 1, wherein each base wall member includes at least one generally outwardly-extending base wall member.

7. The apparatus of claim 1, wherein the base wall member includes inner and outer base wall portions.

8. The apparatus of claim 7, wherein each inner base wall portion includes a generally horizontal inner base wall, and a generally downwardly-extending trunk portion.

9. The apparatus of claim 7, wherein each outer base wall portion includes a plurality of support material-gripping elements adapted to be securely held by the support material formed about the outer base wall.

10. The apparatus of claim 1, wherein each base wall portion includes a plurality of support material-gripping elements adapted to be securely held by the support material formed about the outer base wall.

11. The apparatus of claim 9, wherein the plurality of support material-gripping elements comprise one of apertures and posts formed in the outer base wall to receive the support material.

12. The apparatus of claim 7, the inner base wall portion having an upwardly opening channel, and the separate end plate member includes a pair of wing members, the respective wing members being operable to be slidably received in the respective channels in the inner base wall portions.

13. The apparatus of claim 1, wherein the trench frame member has a plurality of apertures operable to receive support material to assist in retaining the trench frame member within the support material.

14. The apparatus of claim 1, wherein the side frame members and end plate members are integrally formed.

15. The apparatus of claim 2, wherein at least one cross tie member receives a threaded fastener to permit the trench frame member to be securely mounted to an underlying drainage pipe.

16. The apparatus of claim 1, and an underlying drainage pipe mounted beneath the trench frame member, the pipe connected to a secondary pitched drain pipe, by one of a bell end, tee-member, spigot end, connector, and u-joint member, to facilitate providing drainage of fluid through the trench drain apparatus and underlying pipe to the pitched drain pipe.

17. The apparatus of claim 1, and a channel formed in each base wall member operable to receive respective threaded fasteners securing the grate to the trench frame member.

18. The apparatus of claim 1, wherein the trench frame member is formed of one of injection-molded plastic material and metal material.

19. The apparatus of claim 18, wherein the metal material is formed of one of steel and cast iron.

20. The apparatus of claim 1, wherein the support material is one of concrete, asphalt, crushed limestone, gravel, sand and dirt.

21. The apparatus of claim 1, wherein at least one of the respective base wall members is held in place by a plurality of one of bricks, pavers, and patio blocks.

22. The apparatus of claim 1, wherein the drainage pipe is one of smooth-walled pipe and corrugated pipe.

23. A trench drain apparatus, comprising:

a trench frame having a pair of generally upright one-piece side walls connected together to retain one side wall relative to the other, each side wall having an upper end defining the to of the trench frame member and a lower end defining the bottom of the trench frame member;

a base wall member extending outward form each side wall at a location between the upper end and the lower end;

a support wall having a free end defining the lower end of each side wall, the free ends of the support walls spaced apart and adapted to position the trench frame over, and pressably seal against, an underlying drainage pipe; and a grate member releasably engaging each base wall member of the trench frame at locations that are offset laterally outward from the respective support walls.

24. The apparatus of claim 23, wherein the base wall includes inner and outer base wall portions, the inner base wall portion carrying the support wall.

25. The apparatus of claim 24, and concrete-gripping elements adapted to be tightly held by poured concrete to secure the trench drain apparatus within poured concrete that is poured about the trench drain apparatus and underlying drainage pipe.

26. The apparatus of claim 23, and support material-gripping elements carried by the trench frame and adapted to be tightly held by support material formed about the trench frame and the underlying drainage pipe.

27. The apparatus of claim 23, and cross tie members formed at a plurality of spaced locations along the length of the trench frame side walls to retain the side walls together.

28. The apparatus of claim 23, and end plates to retain together the respective ends of the trench frame side walls.

29. The apparatus of claim 28, and an additional end plate member integrally formed with the trench frame and adapted to be removed therefrom and mounted to the trench frame to close off an open cut end of the trench frame when cut to be shortened to fit a given end use application.

30. The apparatus of claim 24, and upstanding teeth members formed on each inner base wall portion, the teeth members adapted to form with the adjacent side wall a space therebetween to tightly receive the side wall of the associated grate member so as to tightly retain the grate member to the trench frame.

31. The apparatus of claim 29, and the additional end plate member has respective tab members, and each inner base wall portion includes a channel for receiving the respective tab members when the trench frame is cut to be shortened, whereby the additional end plate is retained to the trench frame.

32. The apparatus of claim 23, wherein the respective side walls are generally vertically-aligned.

33. The apparatus of claim 23, wherein the respective support walls are generally vertically-aligned.

* * * * *

UNITED STATES PATENT AND TRADEMARK OFFICE

CERTIFICATE OF CORRECTION

PATENT NO. : 7,413,372 B2
APPLICATION NO. : 11/110588
DATED : August 19, 2008
INVENTOR(S) : Theodore W. Meyers It is certified that error appears in the above-identified patent and that said Letters Patent is hereby corrected as shown below:

On the Title Page:

At field (57), line 14, “later” should be -- latter --.

In the Claims:

At Column 11, line 18, “to” should be -- top --.

At Column 12, line 46, “to” should be -- top --.

Signed and Sealed this

Twenty-fifth Day of November, 2008

JON W. DUDAS
*Director of the United States Patent and Trademark Office*